US005613684A

United States Patent [19]

Gittens et al.

[11] Patent Number: 5,613,684

[45] Date of Patent: Mar. 25, 1997

[54] GAME PLATFORM FOR MAGNETIC DART GAME

[76] Inventors: Simon Gittens, 336 MacKay Street, Ottawa, Ontario K1M 2C1; Paul Yuck, 514 Chenier Road, Aylmer, Quebec J9H 4L4; Michael Kennedy, 898 Elmsmer Road #1, Ottawa, Ontario K1J 7T6; Darren Dofher, #2-151 Bolton Street, Ottawa, Ontario K1N 5B4, all of Canada

[21] Appl. No.: 624,127

[22] Filed: Mar. 29, 1996

[51] Int. Cl.[6] ..... F41J 3/00

[52] U.S. Cl. ..... 273/348.3; 473/570

[58] Field of Search ..... 273/344, 345, 273/346, 347, 317.5, 408, 409

[56] References Cited

U.S. PATENT DOCUMENTS

| | | | |
|---|---|---|---|
| D. 200,418 | 2/1965 | Olsen | 273/408 X |
| 2,227,382 | 12/1940 | Salter | 273/409 |
| 2,477,531 | 7/1949 | Volman | 273/345 |
| 2,683,037 | 7/1954 | Ruczynski et al. | 273/345 |
| 2,928,677 | 3/1960 | McAdam | 273/345 |
| 3,026,110 | 3/1962 | Hess et al. | 273/345 |
| 3,508,752 | 4/1970 | Lemon | 273/345 |
| 3,697,073 | 10/1972 | Dooley | 273/345 X |
| 3,979,117 | 9/1976 | Worsham | 273/408 |
| 4,150,823 | 4/1979 | Boganowski | 273/317.5 |
| 4,183,530 | 1/1980 | Roop | 273/247 |
| 4,681,325 | 7/1987 | Sheem | 273/317.5 X |
| 4,893,822 | 1/1990 | Tesa et al. | 273/409 X |
| 4,974,857 | 12/1990 | Beall et al. | 273/371 |
| 5,005,841 | 4/1991 | Klick | 273/345 |
| 5,005,842 | 4/1991 | Bauer | 273/408 |

*Primary Examiner*—William H. Grieb

*Attorney, Agent, or Firm*—Greer, Burns & Crain, Ltd.

[57] ABSTRACT

A game platform for use with darts, with a surface designed to allow for a wide range of games to be played on the surface. This is achieved by having removable and interchangeable printed surfaces which are simply sheets, each with a different game printed on its surface, that can be held in place over top of the game platform surface with a clear film. The game platform is designed so that it may be used in conjunction with a floor tape, corresponding to the game sheet used, marked with a series of gradations, which is used to determine the throwing distance that a player must throw his darts from, which in turn depends on the player's "position" on the platform.

11 Claims, 3 Drawing Sheets

GAME PLATFORM FOR MAGNETIC DART GAME

The present invention relates to a game platform for use with or without specialized magnetized darts, with a surface designed to allow for a wide range of games to be played on the surface, in conjunction with a floor tape marked with a series of gradations.

BACKGROUND OF THE INVENTION

A number of games have been developed which involve the interaction between a game board and projectile game pieces, including darts. Several of these have been football dart board games.

U.S. Design Pat. No. 200,418 shows a football dart board game with a plurality of offensive and defensive players, the players diminishing in size as the players move up the playing field.

U.S. Pat. No. 4,681,325 discloses a football dart game with offensive and defensive targets of varying sizes.

U.S. Pat. Nos. 3,979,117, 4,893,822, and 5,005,842 each disclose dart games which simulate a football game.

U.S. Pat. No. 3,697,073 discloses a golf dart game with provisions for two positions from which players throw the darts.

U.S. Pat. No. 2,227,382 discloses a football dart game having smaller target areas in the end zone.

U.S. Pat. No. 4,183,530 discloses a football dart game with provisions for defensive and offensive play.

U.S. Pat. No. 4,150,823 discloses a football dart game with paired offensive and defensive players.

U.S. Pat. No. 5,005,841 discloses a game board for receiving magnetic pieces.

It should be noted that in all existing dart related games, except for U.S. Pat. No. 3,979,073, that only one throwing position is selected. This position is generally denoted as a single mark on the floor at a predetermined distance from the hanging game board.

The traditional darts presently being used all have a sharp pointed tip. It is this tip that penetrates the target area and determines the exact positioning of the projectile in relation to the graphic design on the game board. Although effective, the pointed metal tip has the following drawbacks. (1) The pointed metal tip is designed to puncture all surfaces it comes in contact with, making these types of projectiles dangerous and unsuitable for some people and in some situation. (2) Damage to walls and floors is common due to darts missing the board or bouncing off the target area. (3) Repeated throws to any section of the game board eventually results in deterioration of the graphics on the surface and the physical structure of the game board.

To make the sport safer, darts were designed with suction cups and Velcro® hook and loop fastener pads to replace the metal tipped darts. Although safety improved, the following deficiencies arose. (1) The size of the surface area at the tip of the dart was significantly increased, reducing the precision in accuracy compared to a metal pointed dart. (2) The ability of the Velcro® fastener material and suction cup darts to adhere was not equal to that of the traditional dart. (3) The size of tip required for Velcro® fastener material and suction cup tipped darts reduced the aerodynamics of these darts.

Safety tipped darts replaced the metal tipped section of the traditional darts with a rounded plastic tip. This new type of dart reduced the darts ability to puncture surfaces. The safety tipped darts necessitated that a new type of target area be designed and constructed. (1) The new design required that an expensive injected mold be created. (2) The new target area is composed of a multitude of inverted funnel like recesses which channel the projectile to a predetermined position on the game board. Due to construction of the board, the graphics are not continuous (riddled with holes).

In all existing dart related games, the application of the graphics can only be applied at the production stage, limiting the unique flexibility of changing the graphics to create multiple uses for this product. Furthermore, the quality of graphics are subject to the material available.

SUMMARY OF THE INVENTION

It is an objective of this invention to provide a new and improved game platform which is durable and safe for everyone.

It is another objective of this invention to provide a new and improved game platform which is easy and economical to manufacture.

It is still another objective of this invention to provide a new and improved game platform which is capable of interaction with specialized magnetized game darts.

It is still another objective of this invention to provide a new and improved game platform with removable/interchangeable cover sheet, each printed with a different game, which can be attached to the surface of the game platform, allowing the game platform to effectively become many different games.

It is still another objective of this invention to provide a new and improved game platform which is used in conjunction with a floor tape marked with gradations which correspond to a player's "position" on the platform to produce an interactive, competitive and novel game concept.

In accordance with one aspect of the present invention, there is provided a game apparatus comprising: a) a game platform, said game platform comprising a steel sheet embedded between a sheet of flexible material and a laminated paper sheet, and a removable and interchangeable loose game sheet held in place by a clear film; b) magnetized darts to be thrown at the game platform; c) a floor tape marked with gradations corresponding to a position on the game platform, used to determine the throwing distance that a player must throw his darts from: whereby said game platform is interacting with said magnetized darts.

Further objects and advantages of the present invention will be apparent from the following description, reference being made to the accompanying drawings, wherein preferred embodiments of the invention are clearly shown.

The foregoing objectives are achieved by the present invention.

BRIEF DESCRIPTION OF THE DRAWINGS

The present invention will be further understood from the following description with reference to the drawings in which.

DETAILED DESCRIPTION OF THE INVENTION

The Game Platform

The traditional dart board is a circular surface which does not lend itself well to rectangular games. Rectangular games applied to this traditional circular surface would be too small, making targets too difficult to hit.

Figure 1:
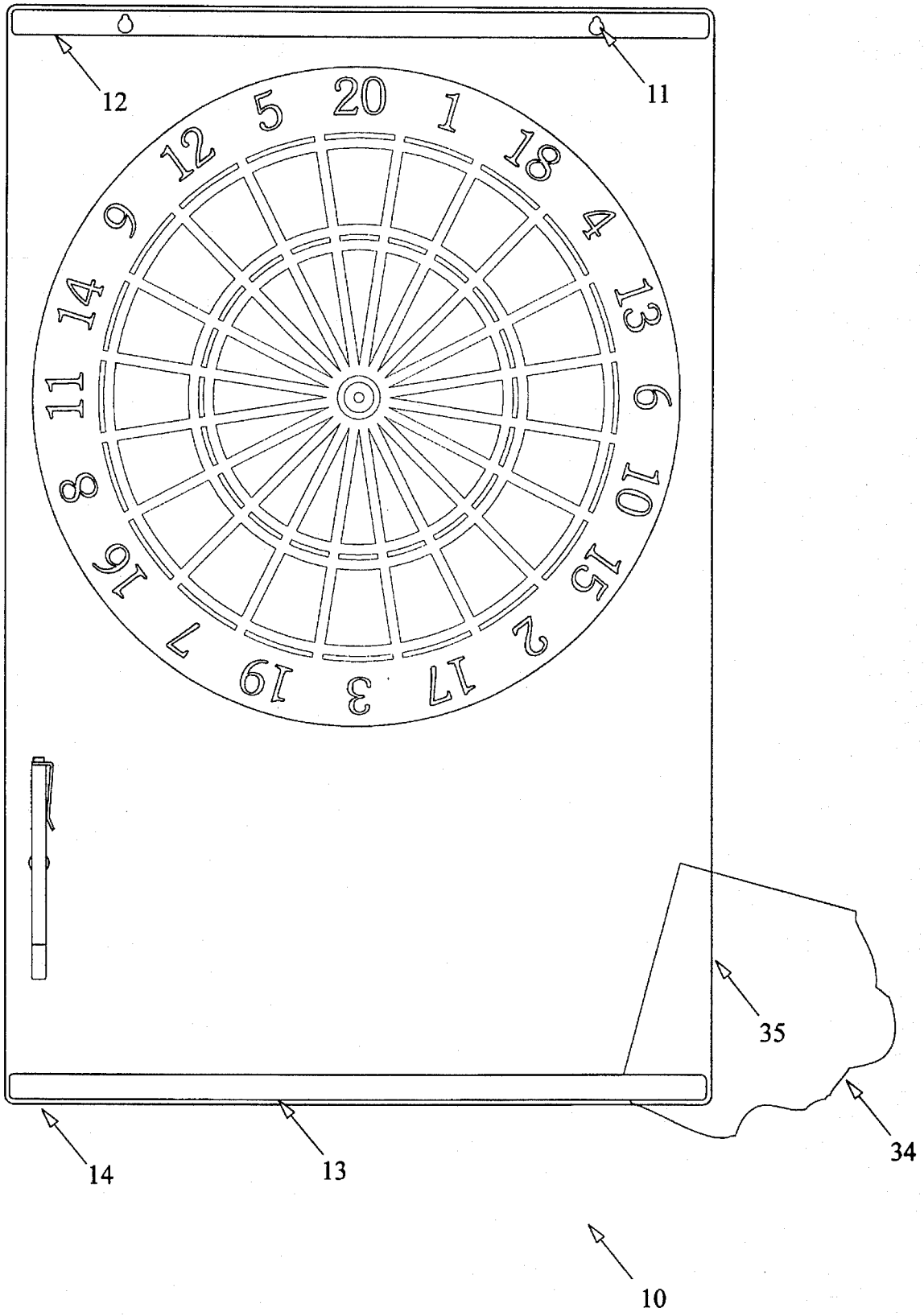
FIG. 1 illustrates a plan view of a game platform.

FIG. 1 shows the game platform, generally 10, provided with holes 11 for hanging purposes, illustrated with a dart field as one embodiment of the invention, of this design as being rectangular in shape to allow for a wide range of games to be played on the surface. For most sports games a rectangular surface is ideal as it resembles the shape of the actual playing surface. Football fields, soccer fields, rugby fields, hockey rinks, swimming pools, basketball courts and most other surfaces where sports are played are rectangular in shape. For sports such as golf where the playing surface is varied, a rectangular game platform surface is again ideal for representing the actual sport, as a rectangular map view of the course could be used. The size of the rectangular surface for this design allows for a wide range of sports games to be represented and also allows for the traditional dart board to be represented.

Figure 3:
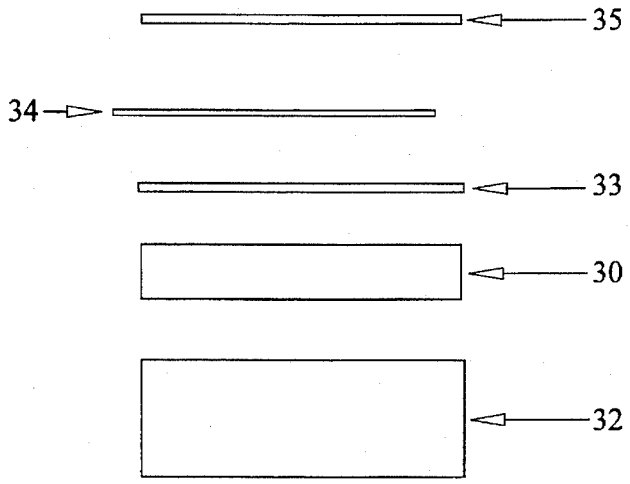
FIG. 3 illustrates an exploded side view of the game platform showing the different layers.

As shown in FIG. 3, the magnetic game platform 10 is constructed from a sheet of steel 30 with sufficient thickness so that when the magnetized dart 20 is thrown at the surface it will not fall off or slip from the position of initial contact. The thicker the sheet, the greater the force of attraction between the game platform 10 surface and the magnetized dart 20. However, after a certain thickness there is no significant increase in this force of attraction. The game platform 10 of this design uses a steel sheet 30 of 22 gauge steel to achieve the required force of attraction.

The steel sheet 30 on its own is a very dangerous element as the edges are thin and the sheet 30 is heavy. If this steel sheet 30 was dropped from even knee height, it could cut into the surface that it impacted with. To prevent this, the steel sheet 30 is glued and attached to a sheet of flexible material 32, which also dampens or absorbs the vibration and noise of the magnetized dart 20 hitting the game platform 10 surface. The edges of the flexible material 32 are not dangerous and due to its soft nature, the impact would be absorbed by it in the event that the game platform 10 is dropped. A paper sheet 33 is laminated to the steel sheet 30. A loose game sheet 34 can be inserted between the laminated paper sheet 33 and a clear film 35. The clear film 35 is used to protect the printed loose game sheet 34 from being damaged from the impact of the magnetized dart 20. The clear film 35 also serves as a holding mechanism for the loose game sheet 34 by laying over top. The clear film 35 is permantly attached at the top 12 of the game platform 10, and with a magnetic strip 13 is secured temporarily at the bottom edge 14 to hold the inserted loose game sheet 34. New and different loose game sheets 34 can therefore be inserted by simply lifting the bottom edge 14 of the magnetic strip 13. Furthermore, dry erase markers can be used on the clear film 35 to keep scores or mark positions.

The game platform 10 is designed to allow for a wide range of games to be played on the surface. This removable/interchangeable loose game sheet 34, is simply a sheet with a game printed on the surface that can be held in place over top of the magnetic surface. The material used in this design is a semi rigid paper stock, however any material that meets the above criterias could be used.

The game platform 10 allows many different games to be played on the same surface. To produce different games for the platform is simply a matter of printing a new loose game sheet 34.

In order to prevent more than one target from being hit by the same dart 20, a space which is equal to or greater than the diameter of the magnet 21, is generally placed between the targets on the loose game sheet unless creating controversy as part of the game is important.

The Magnetic Darts

Figure 2:
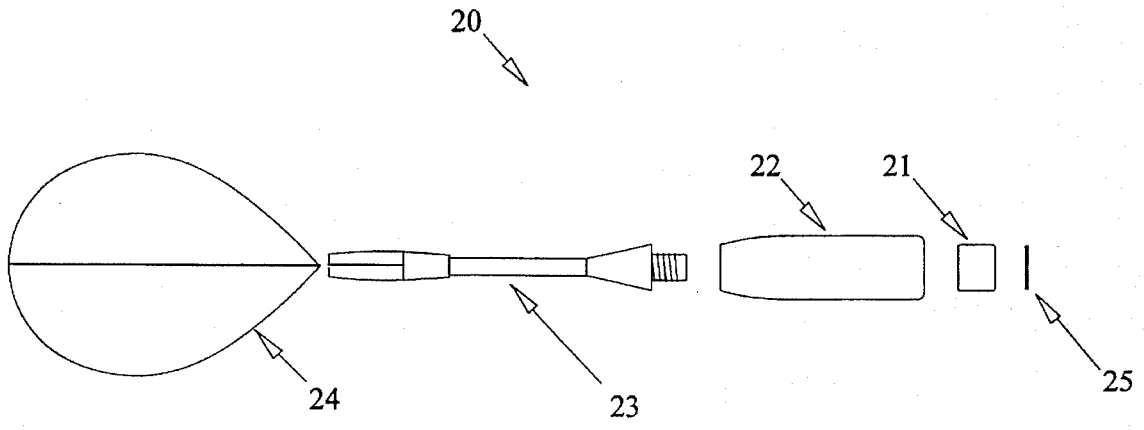
FIG. 2 illustrates an exploded view of a magnetized dart as used with the game platform.

As shown in FIG. 2, in this innovation a small rare earth magnet 21 is used to replace the pointed section of a traditional dart. The exceptional magnetic strength of the tip of this innovative dart 20 is sufficient to securely hold the projectile to the steel sheet 30 through the clear film 35. The strength of the magnet 21 is such that the dart 20 adheres firmly at the point of contact without bouncing off or slippage when thrown at an average speed of 40 km per hour from a distance of up to 12 feet from the target.

Neodymium magnets (Nd—Fe—B) are composed of neodymium, iron, boron and a few transition metals. Samarium cobalt magnets (SmCo) are composed of samarium, cobalt and iron. These two type of magnets are commonly referred to as "Rare Earth Magnets".

Rare Earth magnets are extremely strong for their small size, thus meeting the specific requirements of strength and size needed herein. The magnet 21 is cylindrical in shape and has a nickel coating which provides an added level of durability. The magnet 21 is also available without nickel plating.

The magnetized darts 20 are similar in design to the standard dart. Two options are available. One, the unibody dart's barrel and shaft are one piece, reducing assembly and cost. Second, (as illustrated in FIG. 2) it is also possible to have a dart comprised of a barrel 22 which is fitted with the magnetic tip (or magnet 21). This sectional dart is designed to accept the standard shaft 23 and flights 24 commonly used for traditional darts. The tap size on the barrel 22 of the magnetized dart 20 is the same size and thread ratio as the standard dart. This ability to interchange parts reduces the cost to the consumer already owning darts, and also allows the customization of the darts (ie: Length of shaft and flight size and the overall weight to suit their particular throwing style).

These magnetized darts 20 have a blunt end and are safer than traditional darts. The small diameter of the magnets 21 provides greater accuracy than that found with Velcro® fasterner material or suction cup tipped darts and also makes the magnetic dart more aerodynamic. The magnetic strength of the rare earth magnets 21 greatly reduces the incidence of darts bouncing off of the game platform or not adhering properly to the target area, which is a common problem in dart games. The magnetic element of these innovative darts 20 also reduces the amount of velocity needed for the darts 20 to adhere to the target area. A soft plastic covering 25 is added to protect objects and surfaces from denting and damage caused by the impact of the magnet 21. Furthermore, magnetized darts 20 do not need to be sharpened as do traditional darts.

In order to accurately determine the dart's 20 position on the surface, it is essential that the point where the magnet 21 makes contact with the surface be very visible and defined. The magnet 21 used in this design has a sharp cylindrical shape. The magnet 21 protrudes slightly from the end of the barrel 22 of the dart 20 allowing it to be clearly seen, thus making it easy to determine whether or not the target has been hit.

The barrel 22 of the dart 20 helps to reduce the magnetic forces from the cylindrical sides of the magnet 21. If the barrel 22 is too narrow, the side magnetic forces will penetrate and cause the dart 20 to fall over and be stuck sideways to the game surface. If the barrel 22 is too wide, the view of the magnet 21 which protrudes from the end will be obscured, thus making it difficult to discern which target has been hit.

The use of these magnetized darts in combination with the steel sheet 30 and loose game sheet 33 and clear film 35 means that the steel sheet 30 will not be damaged by repeated use unlike the traditional dart boards; the loose game sheet 33 and clear film 35 will not be damaged by the piercing action common to traditional darts; graphic quality is greatly improved and can be easily applied directly to the printed surface materials through a printing/screening process; loose game sheets 33 can be removed and interchanged to produce a new game or a customized variation of a game (ie: increase the difficulty of the game or include your favorite team); and the construction of the steel sheet 30 target area does not require the expensive tooling that is present in all other existing dart boards.

The Floor Tape

Figure 4:
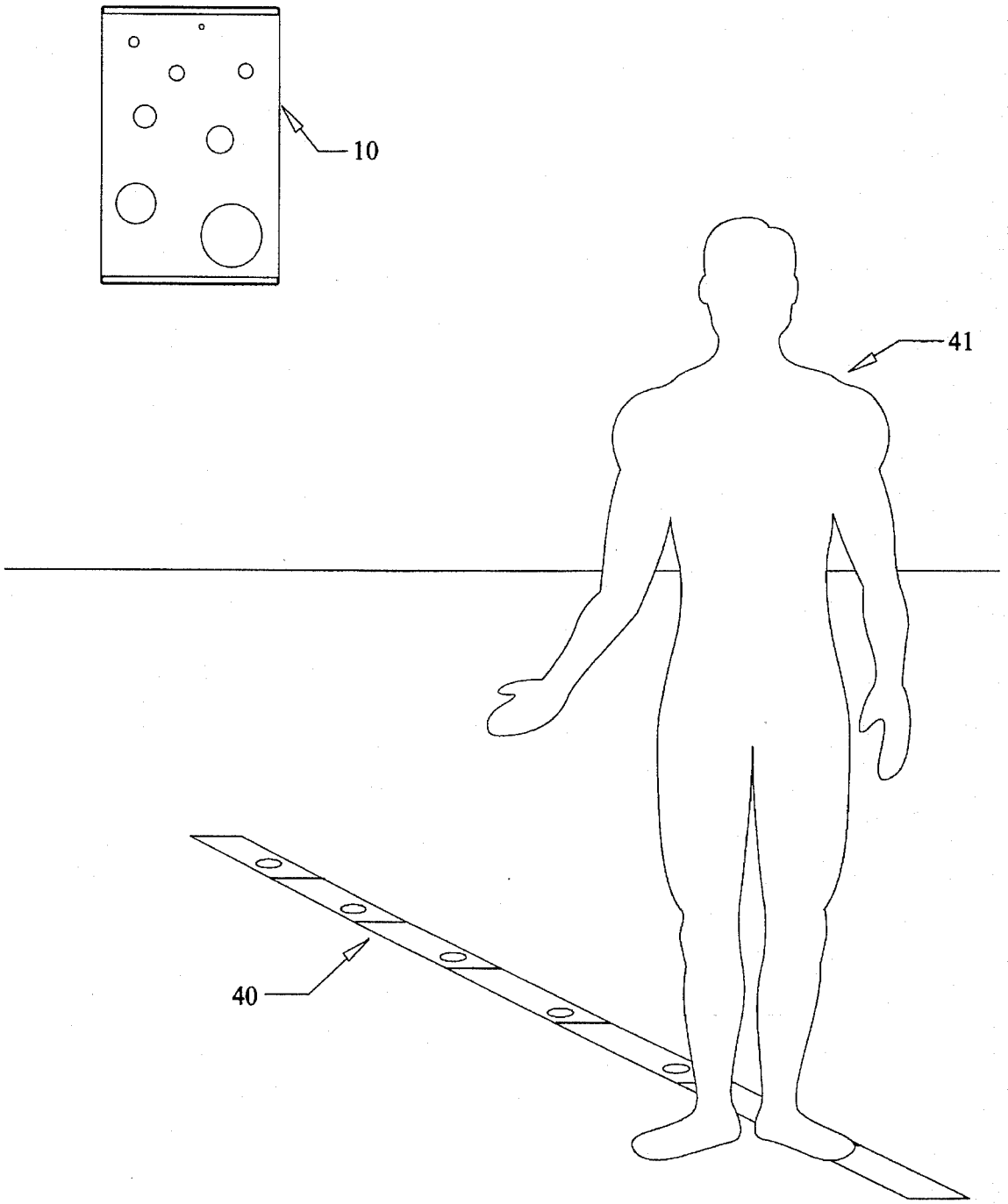
FIG. 4 illustrates a perspective view of the floor tape as used in combination with the game platform.

FIG. 4 illustrates a floor tape 40 used as a measuring device in combination with the game platform 10. The floor tape 40 is made of a durable material which when placed on the floor is centered on the game platform 10 hanging on the wall. The different zones, yardlines and numeric measurements on the floor tape 40 are clearly marked, making them easy to read. The purpose of the floor tape 40 is to physically position the competitors 41 at set distances from the hanging game platform 10. These set distances are a direct result of the success of the players in hitting their players or other targets and scoring points.

The variable throwing positions test the skills and accuracy by causing the players to adjust the power and trajectory of each throw. This type of adjustment process tends to have an equalizing effect on the abilities of each player. A professional dart player for instance may have a high accuracy rate at a set distance, but may have difficulty repeating that same rate if moved from that position. This effect is intentional and increases the competition and realism of the game.

The Football Game

In its broadest form, as shown in FIG. 1, the invention relates to a dart game which includes a dart board and a floor tape 40. In a particular embodiment, that is as a football game, the game platform 10 design corresponds in general to a typical football field having a number of yard lines, and an end zone with a goal post. When hung on the wall, the lower portion of the platform represents a player's furthest position from the end zone while the top of the platform represents the goal area. Spread about the playing area are a number of graphics depicting a number of paired football players, one player having a uniform of one color and the other member of the pair having a uniform of a different color (offensive and defensive players). Paired players at the bottom of the platform are of larger size than those at the top of the platform. The paired players get closer in proximity to each other as their placement moves up the platform.

Also forming a component of the game is a floor tape 40 which is marked with a series of gradations, which would represent yard lines on the game platform 10 in the football game embodiment of the invention. In general, the tape 40 is used to determine the throwing distance that a player must throw his darts from, which in turn depends on the player's "position" on the platform.

Play proceeds following the general rules of football, that is, each player being in an offensive or defensive position and attempting to move up the field towards the goal area. In general, an offensive player is able to improve his position on the field by throwing a dart in order that it strikes the graphic of a paired player corresponding to his team color. A pass is successful if the player hits his own player. Naturally, in view of the diminishing target size as one approaches the goal area of the platform, it becomes more difficult to complete a pass, and hence score. Similarly, a player's throwing position is changed depending on his particular position on the field. Thus, a player, as he moves up the field, must be constantly changing his throwing location, thereby requiring a skill in being able to adjust one's throwing technique for each position.

On defense, a player may successfully block an offensive pass by landing the dart in the defensive player, or if the offensive throw hits the defensive player, this is considered an interception.

As can be seen from the above, it is easy to understated that the interaction between a floor tape 40, a game platform 10 and a projectile, in this case a dart 20, can exist not only with respect to the football game but generally speaking with any type of games for which a loose game sheet 34 can be produced and adapted.

Furthermore, it should be understood that the combination of magnetized darts and steel sheet is a preferred embodiment, but in no way should be seen as restricting the type of surface that can be used, and that the interaction between the floor tape 40, the game platform 10 and the projectiles (darts 20) is most important, and achievable by merely adapting the projectiles to any surface, for instance cork.

The invention may be embodied in other specific forms without departing from the spirit or essential characteristics thereof. The present embodiments are therefore to be considered as illustrative and not restrictive, the scope of the invention being indicated by the appended claims rather than by the foregoing description, and all changes that come within the meaning and range of equivalency of the claims are therefore intended to be embraced therein.

The embodiments of the invention in which an exclusive property or privilege is claimed are defined as follows:

1. A game apparatus comprising:

a) a game platform, said game platform comprising a steel sheet embedded between a sheet of flexible material and a paper sheet, and a removable and interchangeable loose game sheet held in place by a clear film;

b) magnetized darts to be thrown at the game platform;

c) a floor tape marked with gradations corresponding to a position on the game platform, used to determine the throwing distance that a player must throw his darts from: whereby said game platform interacts with said magnetized darts.

2. The game apparatus of claim 1 wherein the removable and interchangeable loose game sheet is a graphical representation of a game printed on semi-rigid paper stock.

3. The game apparatus of claim 1 wherein the removable and interchangeable loose game sheet is a graphical representation of a playing field with paired offensive and defensive players or targets, the offensive and defensive players being of varying size and proximity consistent with their particular position on the field.

4. The game apparatus of claim 1 wherein the floor tape is made of durable material.

5. The game apparatus of claim 1 wherein the flexible material is used for sound and vibration absorption and protection.

6. The game apparatus of claim 1 wherein the magnetized darts have a protective covering.

7. The game apparatus of claim 1 wherein the magnetized darts incorporate neodymium magnets.

8. The game apparatus of claim 1 wherein the magnetized darts incorporate samarium cobalt magnets.

9. The game apparatus of claim 1 wherein the magnetized darts can be unibody or.

10. The game apparatus of claim 1 wherein the clear film can be written on with a dry erase marker.

11. The game apparatus of claim 2 wherein the removable and interchangeable loose game sheet is a graphical representation of a playing field with paired offensive and defensive players or targets, the offensive and defensive players being of varying size and proximity consistent with their particular position on the field.

* * * * *